US007141003B2

(12) United States Patent
Wu

(10) Patent No.: US 7,141,003 B2
(45) Date of Patent: Nov. 28, 2006

(54) EXERCISER WITH AN ADJUSTABLE DAMPING DEVICE

(76) Inventor: Shen Yi Wu, No. 10, Fongiheng Rd., Kung Yeh Lane, Wufong Township, Taichung County 413 (TW)

( * ) Notice: Subject to any disclaimer, the term of this patent is extended or adjusted under 35 U.S.C. 154(b) by 428 days.

(21) Appl. No.: 10/814,507

(22) Filed: Apr. 1, 2004

(65) Prior Publication Data

US 2005/0227832 A1 Oct. 13, 2005

(51) Int. Cl.
*A63B 22/00* (2006.01)
*A63B 21/12* (2006.01)

(52) U.S. Cl. ..... 482/51; 482/114

(58) Field of Classification Search ..... 482/51, 482/52, 72, 92, 114, 115, 118, 138, 149, 908; 601/23, 24, 26–28, 31–36
See application file for complete search history.

(56) References Cited

U.S. PATENT DOCUMENTS 3,525,522 A * 8/1970 Piller ..... 482/80
4,684,126 A * 8/1987 Dalebout et al. ..... 482/138
5,282,776 A * 2/1994 Dalebout ..... 482/118
5,792,027 A * 8/1998 Gvoich ..... 482/51
5,830,107 A * 11/1998 Brigliadoro ..... 482/1
5,833,575 A * 11/1998 Holslag ..... 482/51

* cited by examiner

*Primary Examiner*—Jerome Donnelly
*Assistant Examiner*—Tam Nguyen
(74) *Attorney, Agent, or Firm*—Rosenberg, Klein & Lee

(57) ABSTRACT

An exerciser with an adjustable damping device includes a main frame and the adjustable damping device is mounted to the main frame. The adjustable damping device includes a post and two stopper respectively sleeved on two opposite sections of the post. Two sleeves are respectively sleeved on two opposite sections of the post. Two friction washers are respectively sandwiched between a corresponding stopper and sleeve. A shaft extends through the post. A locking set and an adjusting set are respectively mounted to two opposite ends of the shaft to hold the sleeves and two friction washers in place. The adjusting set can reduce the distance between the two sleeves to promote the friction force between the two stoppers, the two friction washers and the two sleeves and provide a suitable damping to the exerciser.

5 Claims, 6 Drawing Sheets

EXERCISER WITH AN ADJUSTABLE DAMPING DEVICE

BACKGROUND OF THE INVENTION

1. Field of the Invention

The present invention relates to an exerciser, and more particularly to an exerciser with an adjustable damping device.

Idle Damping

2. Description of Related Art

A conventional leg exerciser in accordance with the prior art shown in FIG. 6 comprises a main frame (81) for user to sit thereon. A first slider (82) and a second slider (83) are parallel to each other and respectively reciprocally moved relative to the main frame (81). A first elastic (84) has two opposite ends respectively connected to the first slider (82) and the main frame (81), and a second elastic rope (85) has two opposite ends respectively connected to the second slider (83) and the main frame (81) for providing damping to the conventional leg exerciser.

However, the damping of the conventional leg exerciser from the two elastic ropes (84, 85) cannot be adjusted for various users. The two elastic ropes (84, 85) need to be respectively adjusted such that the elastic force from the two elastic ropes may not be equal relative to each other. Consequently, the legs of the operator cannot be equally trained.

The present invention has arisen to mitigate and/or obviate the disadvantages of the conventional leg exerciser.

SUMMARY OF THE INVENTION

The main objective of the present invention is to provide an improved exerciser with an adjustable damping device that provides a suitable damping to the exerciser.

To achieve the objectives the exerciser in accordance with the present invention comprises a main frame and the adjustable damping device is securely mounted to the main frame. The adjustable damping device includes a post secured on the main frame, the main frame dividing the post into a first section and a second section. A first stopper and a second stopper are respectively sleeved on the first section and the second section of the post and securely abutting against the main frame. A first friction washer and a second friction washer are respectively sleeved on the first section and the second section of the post. A first sleeve and a second sleeve are respectively pivotally sleeved on the first section and the second section of the post. The first friction washer is sandwiched between the first stopper and the first sleeve, and the second friction washer is sandwiched between the second stopper and the second sleeve for providing damping to the exerciser. A shaft sequentially extends through the first sleeve, the post and the second sleeve. A locking set is mounted to a first end of the shaft to prevent the shaft from being rotated relative to the post. An adjusting set is mounted to a second end of the shaft for reducing a distance between the first sleeve and the second sleeve to raise the fraction force between the first stopper, the first friction washer and the first sleeve, and the second stopper, the second friction washer and the second sleeve, whereby the damping from the damping device is adjustable. A first swing arm and a second swing arm are respectively secured connected to the first sleeve and the second sleeve for user to step and achieve a purpose of exercise.

Further benefits and advantages of the present invention will become apparent after a careful reading of the detailed description with appropriate reference to the accompanying drawings.

DETAILED DESCRIPTION OF THE INVENTION

Figure 1:
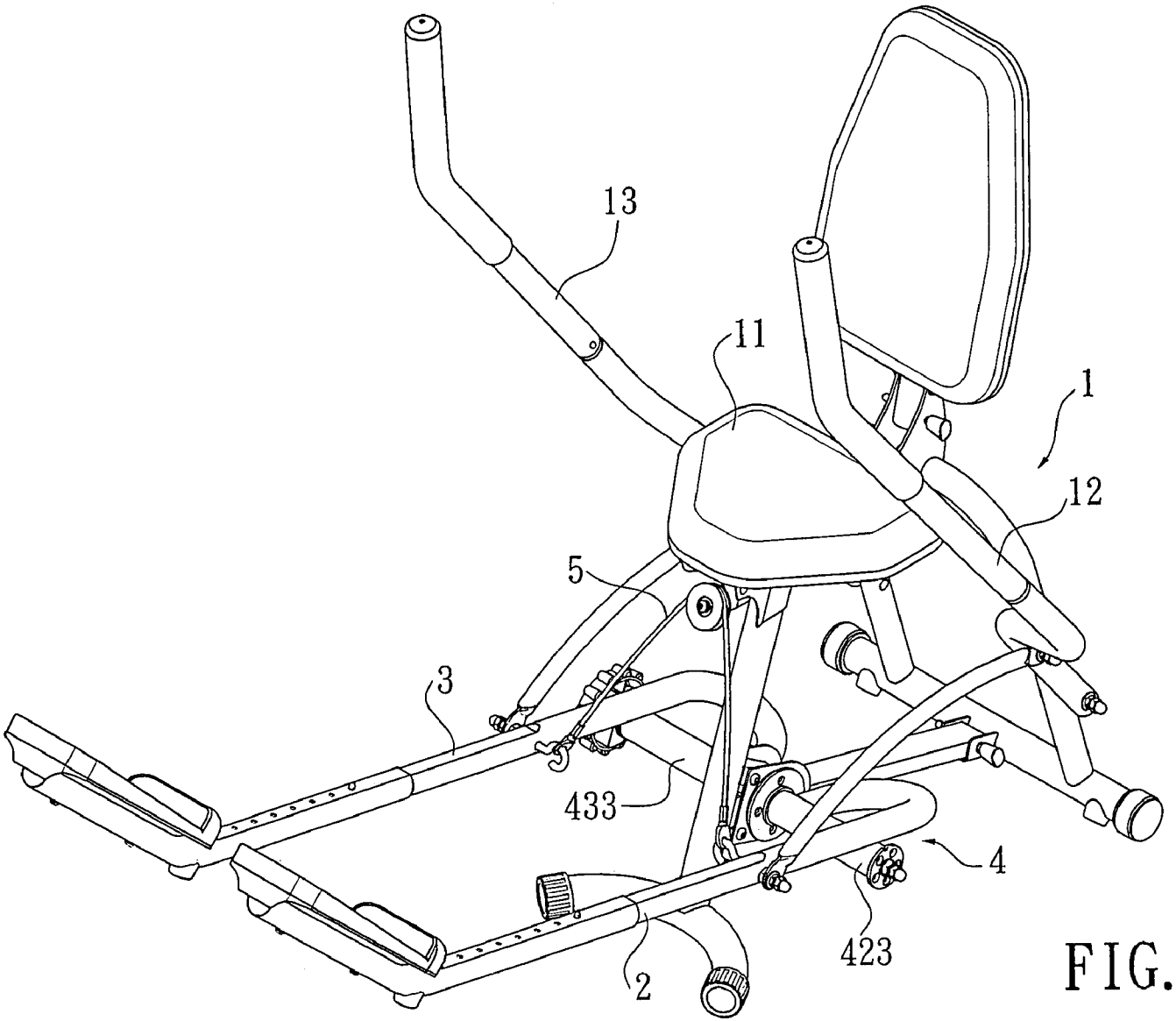
FIG. 1 is a perspective view of an exerciser with an adjustable damping device.
Figure 2:
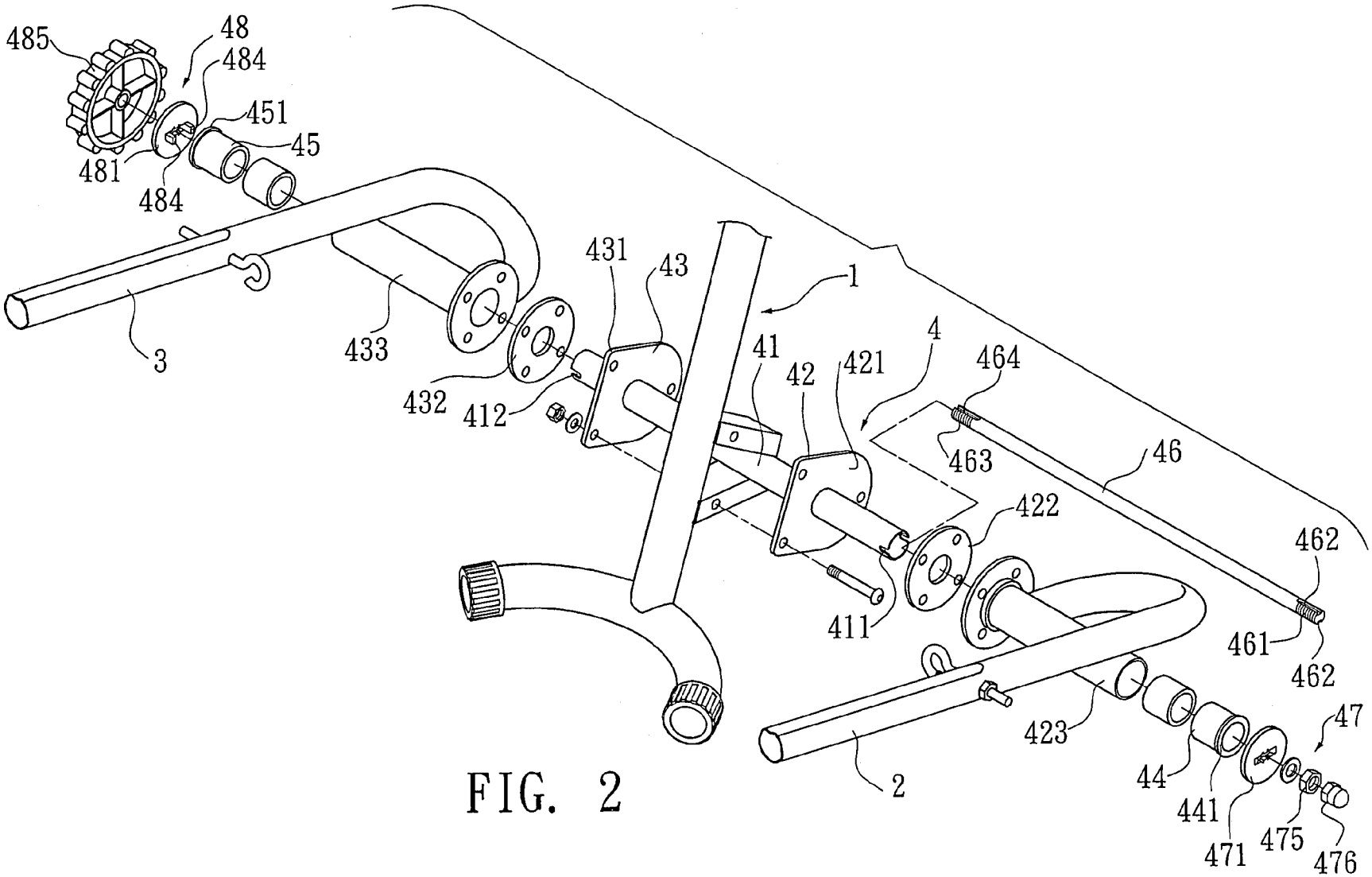
FIG. 2 is a partially exploded perspective view of the exerciser in FIG. 1.
Figure 3:
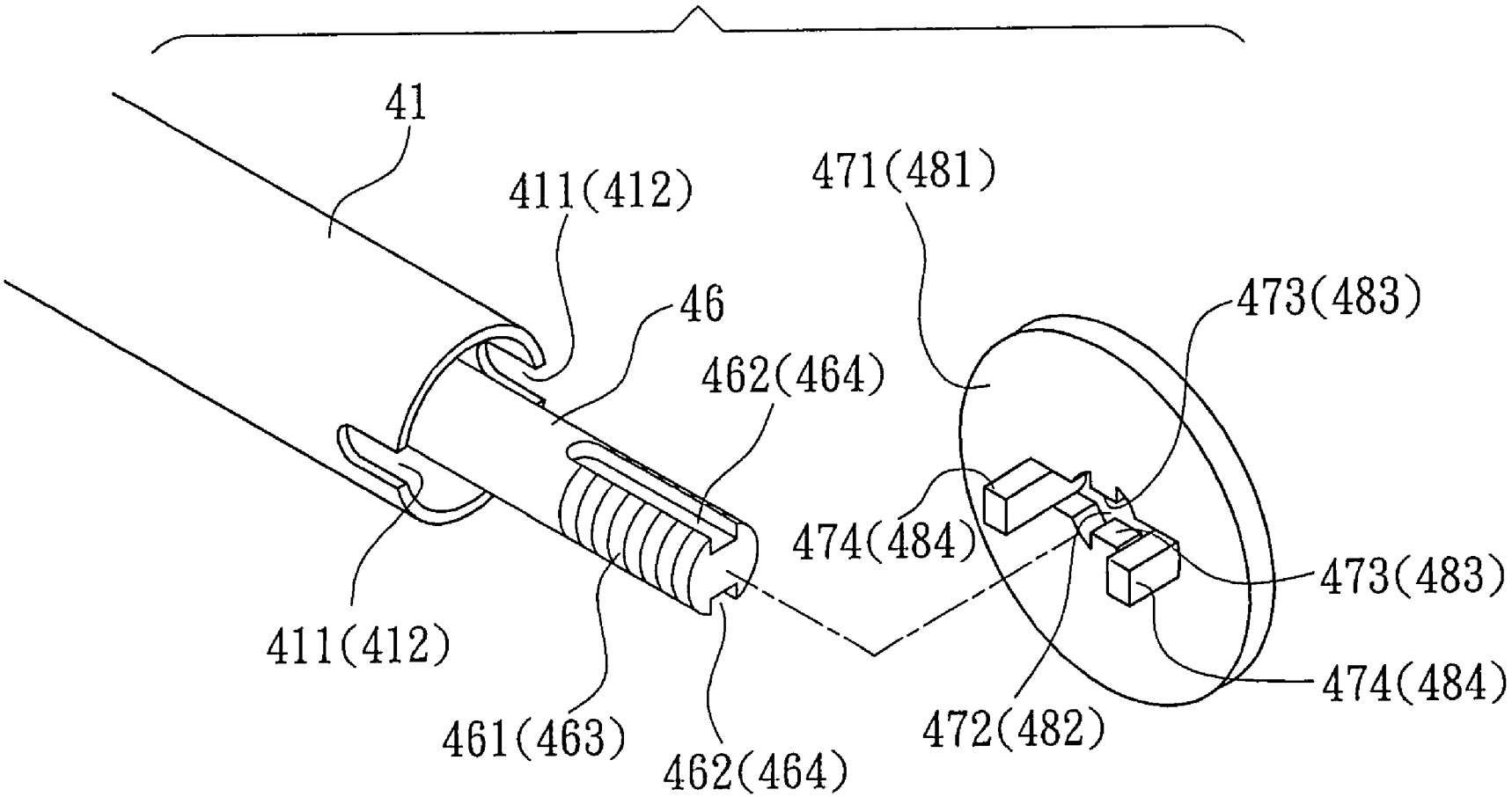
FIG. 3 is a is a partially exploded perspective view of a damping device of the exerciser in accordance with the present invention.
Figure 4:
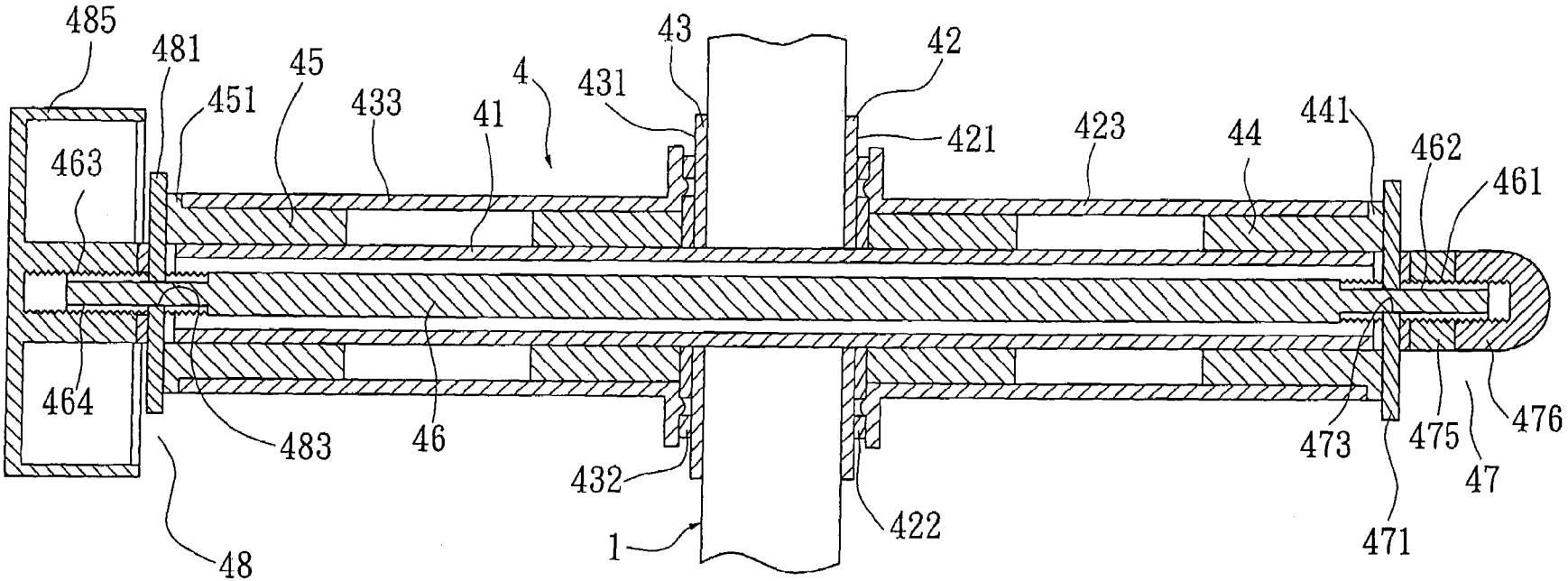
FIG. 4 is a front cross-sectional view of the damping device of the present invention.
Figure 5:
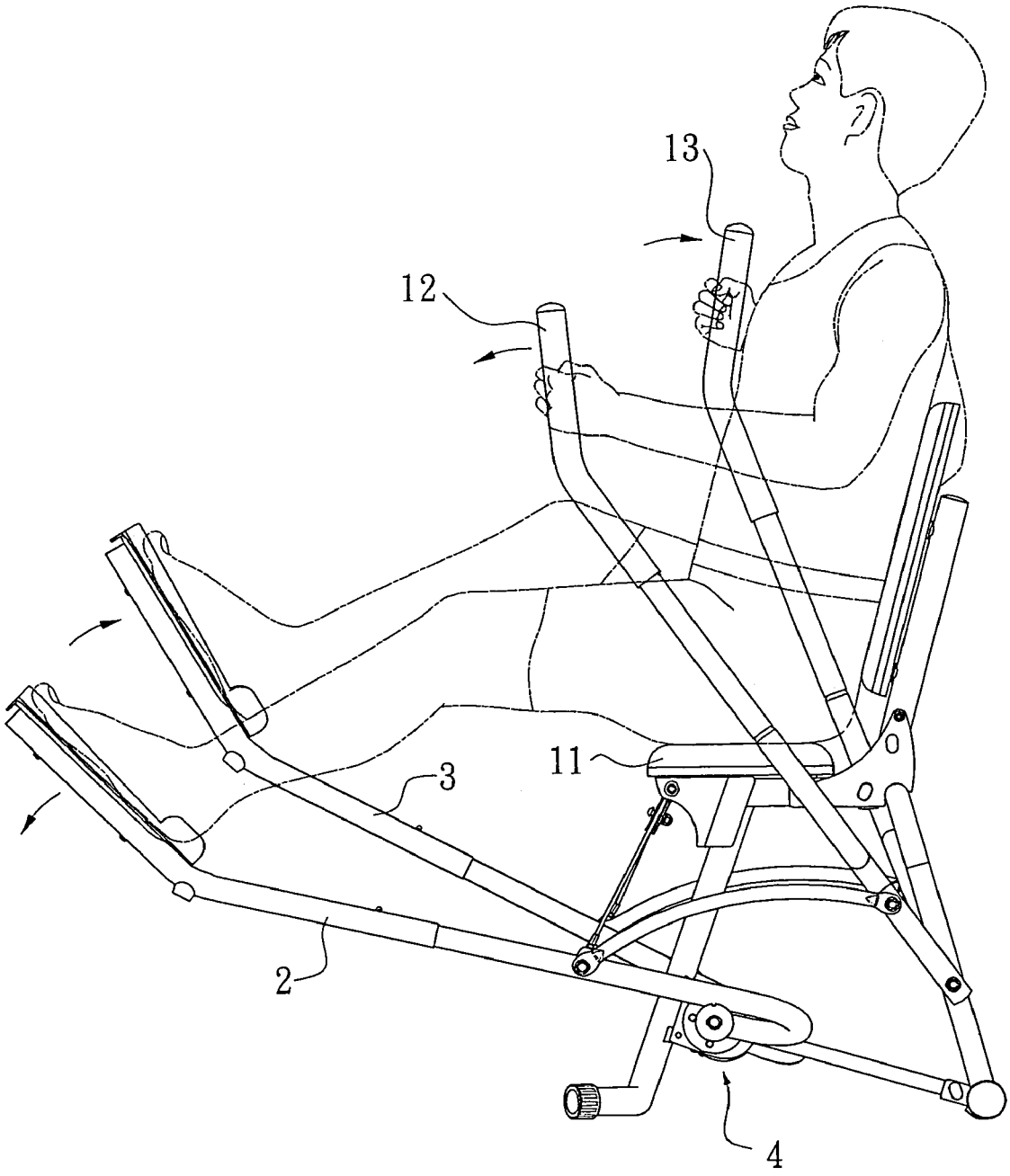
FIG. 5 is a side operational view of the exerciser with an adjustable damping device in accordance with the present invention.
Figure 6:
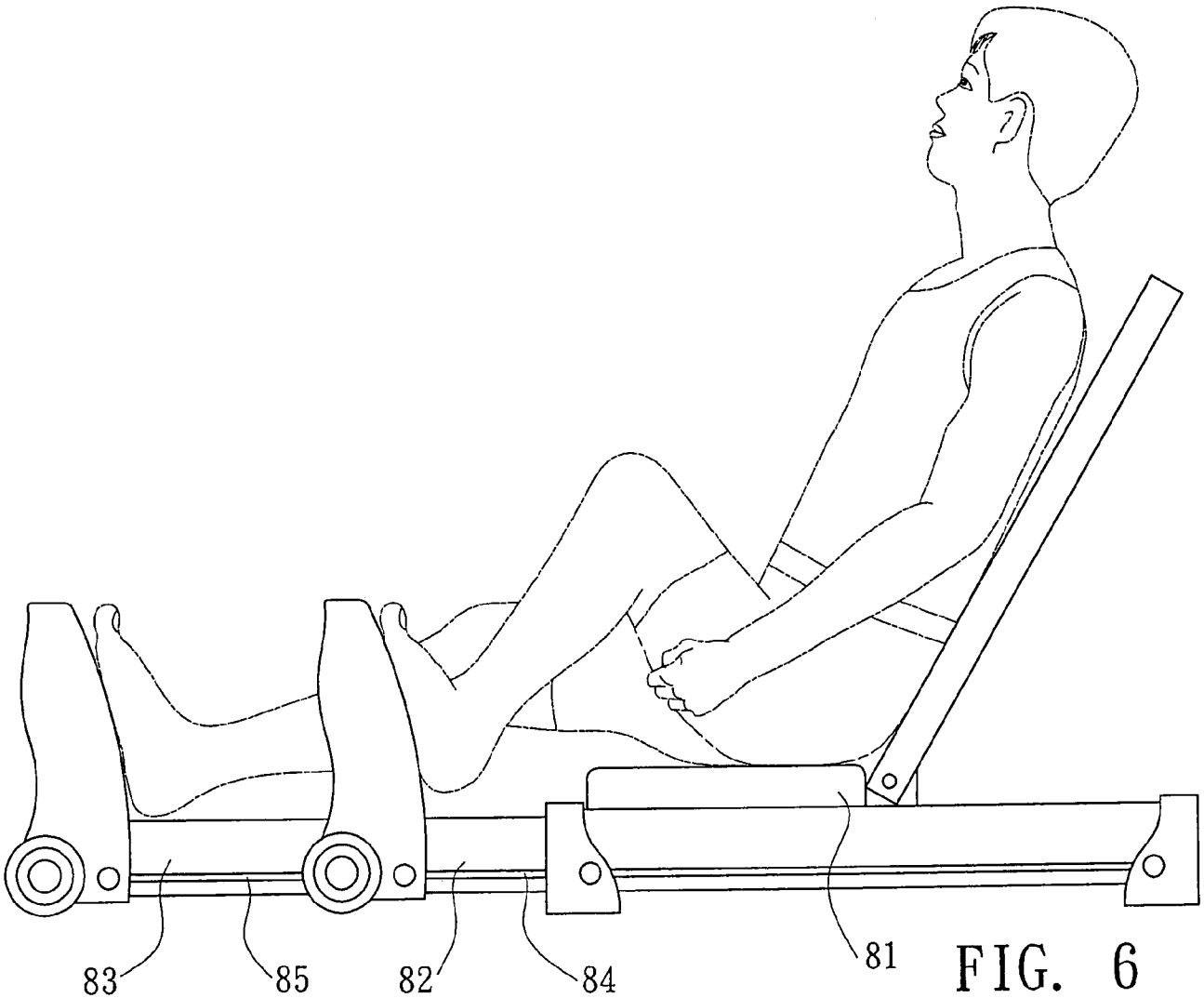
FIG. 6 PRIOR ART
FIG. 6 is a side operational view of a conventional leg exerciser in accordance with the prior art.

Referring to the drawings and initially to FIGS. 1–4, an exerciser with an adjustable damping device in accordance with the present invention comprises main flame (1), a damping device (4) mounted to the main frame (1) and two swing arms (2, 3) respectively pivotally mounted to two opposite ends of the damping device (4).

The main frame (1) includes a cushion (11) mounted thereon and two handle bars (12, 13) pivotally mounted to two opposite side of the main frame (1).

The damping device (4) includes a post (41) horizontally secured on the main frame (1). The main flame (1) equally divides the post into a first section and a second section. The post (41) includes two first indentations (411) defined in a first end of the post (41) and two second indentations (412) defined in a second end of the post (41). The two first indentations (411) diametrically correspond to each other and the two second indentations (412) diametrically correspond to each other. A first stopper (42) and a second stopper (43) are respectively sleeved on the first section and the second section of the post (41) and securely abutting against the main frame (1). The first stopper (42) and the second stopper (43) respectively have a first friction face (421) and a second friction face (431) formed opposite to each other. A first friction washer (422) and a first sleeve (423) are sequentially rotatably sleeved on the first section or the post (41), and a second function washer (432) and a second sleeve (433) are sequentially rotatably sleeved on the second section of the post (41). A first lining (44) and a second lining (45) are respectively inserted into the first sleeve (423) and the second sleeve (433). The first lining (44) and the second lining (45) respectively have an annular flange (441, 451) outwardly extending therefrom to prevent the first lining (44) and the second lining (45) from overly passing into the first sleeve (423) and the second sleeve (433). A shaft (46) sequentially extends through thirst lining (44) the post (41) and the second lining (45). The shaft (46) includes a first end (461) and a second end (463) being threaded. The shaft (46) includes two first grooves (462) defined in the first end (461) and diametrically corresponding to each other; and two second grooves (464) defined in the second (462) and diametrically corresponding to each other. A locking set (71) is mounted to the first end (461) of the shaft (46) and an adjusting set (48) is mounted to the second end (463) of the shaft (46).

The locking set (47) includes a first brake plate (471) mounted to the first end (461) of the shaft (46). The first brake plate (471) includes a through hole (472) defined therein to allow the shaft (46) extending through the first brake plate (471). Two first protrusions (473) extend from an inner periphery of the through hole (472) in the first brake plate (471) and diametrically correspond to each other. Each first protrusion (473) received in a corresponding one of the two first grooves (462) in the first end (461) of the shaft (46) to prevent the first brake plate (471) from being rotated relative to the shaft (46). The first brake plate (471) includes two second protrusions (474) extending therefrom and aligning with the two first indentations (411) in the post (41). Each second protrusion (474) is received in a corresponding one of the two first indentations (411) when the two first protrusions (473) are received in the two first grooves (462) in the first end (461) of the shaft (46) to prevent the shaft (46) from being rotated relative to the post (41). A first nut (475) is screwed onto the first end (461) of the shaft (46) to hold the friction washer (422), the sleeve (423), the lining (44) and the first brake plate (471) in place. A second nut (476) is screwed onto the first end (461) of the shaft (46) to securely abut and lock the first nut (475).

The adjusting device (48) includes a second brake plate (481) mounted to the second end (463) of the shaft (46). The structure of the second brake plate (481) is the same as that of the first brake plate (471) and includes a through hole (482), two first protrusions (483) extending from an inner periphery of the through hole (482) in the second brake plate (481) and two second protrusions (484) extending from the second brake plate (481). The two first protrusions (483) are respectively received in a corresponding one of the two second grooves (464) in the second end (463) of: the shaft (46) to prevent the shaft (46) from being rotated relative to the second brake plate (481). The two second protrusions (484) are respectively received in a corresponding one of the two second indentations (412) in the second end of the post (41) to prevent the second brake plate (481) from being rotated relative to the post (41). A knob (485) with a threaded hole (not numbered) is screwed onto the second end (463) of the shaft (46) to hold the second brake plate (481), the second lining (45) the second sleeve (433) and the second friction washer (432) in place.

A first swing arm (2) and second swing arm (3) are respectively securely connected to the first sleeve (423) the second sleeve (433) for user to step thereon. The first friction washer (422) is sandwiched between the first stopper (42) and the first sleeve (423), and the second friction washer (432) is sandwiched between the second stopper (43) and the second sleeve (433). Consequently, the damping device (4) can provide a certain damping to the first swing arm (2) and the second swing arm (3) for achieving the purpose of exercise.

The user only needs to rotate the knob (85) to slightly shorten a distance between the first sleeve (423) and the second sleeve (433) to promote the friction force between the two friction washers (422, 432) and the two sleeves (423, 433) and provide a suitable damping to the first swing arm (2) and the second serving arm (3) when the two friction washers (422, 432) are worn out.

Although the invention has been explained in relation to its preferred embodiment, it is to be understood that many other possible modifications and variations can be made without departing from the spirit and scope of the inventions as hereinafter claimed.

What is claimed is:

1. An exerciser with an adjustable damping device, comprising:

a main frame;

the adjustable damping device securely mounted to the main frame and including:

a post secured on the main frame, the main frame dividing the post into a first section and a second section;

a first stopper and a second stopper respectively sleeved on the first section and the second section of the post and securely abutting against the main flame;

a first friction washer and a second friction washer respectively sleeved on the first section and the second section of the post;

a first sleeve and a second sleeve respectively pivotally sleeved on the first section and the second section of the post, the first friction washer sandwiched between the first stopper and the first sleeve, and the second friction washer sandwiched between the second stopper and the second sleeve for providing damping to the exerciser;

a shaft sequentially extending through the first sleeve, the post and the second sleeve;

a locking set mounted to a first end of the shaft to prevent the shaft from being rotated relative to the post; and an adjusting set mounted to a second end of the shaft for reducing a distance between the first sleeve and the second sleeve to raise the friction force between the first stopper, the first friction washer and the first sleeve, and the second stopper, the second friction washer and the second sleeve, whereby the damping from the damping device is adjustable; and a first swing arm and a second swing arm respectively secured connected to the first sleeve and the second sleeve for user to step and achieve a purpose of exercise.

2. The exerciser as claimed in claim 1, wherein the first stopper and the second stopper respectively comprises a first friction face and a second friction face formed to respectively abut the first friction washer and the second friction washer for providing a damping effect to the exerciser.

3. The exerciser as claimed in claim 2, wherein the adjustable damping device comprises a first lining and a second lining respectively inserted into the first sleeve and the second sleeve, the first lining and the second lining respectively sleeved on the first end and the second end of the post, the first lining and the second lining respective including a flange outwardly extending therefrom to prevent the first lining and the second lining from being overly inserted into the first sleeve and the second sleeve.

4. The exerciser as claimed in claim 1, wherein:

the post comprises a first end having two first indentations defined therein, the two first indentations diametrically corresponding to each other;

the first end of the shaft is threaded and has two first grooves defined therein, the two first grooves diametrically corresponding to each other; and the locking set comprises a first brake plate sleeved on the first end of the shaft and including:

a through hole defined in the first brake plate to allow the first end of the shaft extending through the first brake plate;

two first protrusions inwardly extending from an inner periphery of the through hole and each movably received in a corresponding one of the two first grooves to prevent the shaft from being rotated relative to the first brake plate;

two second protrusions extending from the first brake plate and each received in a corresponding one of the two first indentations in the first end of the post to prevent the first brake plate from being rotated relative to the post;

a first nut screwed onto the first end of the shaft to hold the first brake plate, the first lining, the first sleeve and the first friction washer in place; and a second nut screwed onto the first end of the shaft and securely abutting the first nut to hold the first nut in place.

5. The exerciser as claimed in claim 1, wherein:

the post comprises a second end having two second indentations defined therein, the two second indentations diametrically corresponding to each other;

the second end of the shaft is threaded and has two second grooves defined therein, the two second grooves diametrically corresponding to each other; and the adjusting set comprises a second brake plate sleeved on the second end of the shaft and including:

a through hole defined in the second brake plate to allow the second end of the shaft extending through the second brake plate;

two first protrusions inwardly extending from an inner periphery of through hole in the second brake plate and each movably received in a corresponding one of the two grooves in the second end of the shaft to prevent the shaft from being rotated relative to the second brake plate;

two second protrusions extending from the second brake plate and each received in a corresponding one of the two second indentations in the second end of the post to prevent the second brake plate from being rotated relative to the post; and a knob with a threaded hole screwed onto the second end of the shaft to hold the second brake plate, the second lining, the second sleeve and the second friction washer in place, the knob being rotated to slightly shorten a distance between the first sleeve and the second sleeve to promote the friction force between the first and second friction washers and the first and second sleeves and providing a damping to the first swing arm and the second swing arm when the first and second friction washers are worn out.

* * * * *